US005405084A

United States Patent [19]

Weston et al.

[11] Patent Number: 5,405,084

[45] Date of Patent: Apr. 11, 1995

[54] NOZZLE ASSEMBLY FOR PREVENTING BACK-FLOW

[75] Inventors: Terence E. Weston, Stradbroke; Stephen T. Dunne, Ipswich, both of England

[73] Assignee: DMW (Technology) Limited, United Kingdom

[21] Appl. No.: 70,306

[22] PCT Filed: Dec. 4, 1991

[86] PCT No.: PCT/GB91/02147

§ 371 Date: Jun. 4, 1993

§ 102(e) Date: Jun. 4, 1993

[87] PCT Pub. No.: WO92/10306

PCT Pub. Date: Jun. 25, 1992

[30] Foreign Application Priority Data

Dec. 4, 1990 [GB] United Kingdom ..... 9026298
Apr. 26, 1991 [GB] United Kingdom ..... 9109072

[51] Int. Cl.[6] ..... B05B 9/04; B05B 11/00

[52] U.S. Cl. ..... 239/11; 239/340; 239/590.3; 239/590.5

[58] Field of Search ..... 239/11, 590, 590.3, 239/590.5, 333, 373, 340, DIG. 23, 323, 350, 575

[56] References Cited

U.S. PATENT DOCUMENTS 460,458 9/1891 Bates .
1,035,261 8/1912 Strumpf .
1,838,873 12/1931 Scott .
2,432,791 12/1947 Osses .
2,676,845 4/1954 Rathsprecher .
2,772,750 12/1956 Bystricky ..... 239/590.5

(List continued on next page.)

FOREIGN PATENT DOCUMENTS 2017366 11/1990 Canada .
0105964 4/1984 European Pat. Off. .
0111875 6/1984 European Pat. Off. .
0255208 2/1988 European Pat. Off. .
0379818 8/1990 European Pat. Off. .
2524348 10/1983 France .
1803541 4/1970 Germany .
0032108 3/1977 Japan ..... 239/590.5
63-232866 9/1988 Japan .
405458 2/1934 United Kingdom .
931089 7/1963 United Kingdom .
1014685 12/1965 United Kingdom .
1131918 10/1968 United Kingdom .
1239855 7/1971 United Kingdom .
1279797 6/1972 United Kingdom .
1291367 10/1972 United Kingdom .
1389702 4/1975 United Kingdom .
1481199 7/1977 United Kingdom .
1493614 11/1977 United Kingdom .
1556977 12/1979 United Kingdom .
2041249 12/1982 United Kingdom .
2209564 5/1989 United Kingdom .
992070A 9/1981 U.S.S.R. .
WO89/07244 8/1989 WIPO .
WO93/02729 2/1993 WIPO .

*Primary Examiner*—William Grant
*Attorney, Agent, or Firm*—Sterne, Kessler, Goldstein & Fox

[57] ABSTRACT

A nozzle assembly which comprises a nozzle aperture for discharge of a fluid as a spray of droplets, and a conduit in fluid flow communication with the nozzle aperture. The flow of fluid through the conduit is restricted by the minimum effective cross-sectional area of the conduit transverse to the line of flow of fluid through the conduit so that back flow of fluid from the nozzle aperture through the conduit at ambient and operational pressure differentials is substantially prevented. The invention further provides for a method of discharging a fluid as a spray of droplets, and a spray generating device which includes the nozzle assembly of the present invention.

16 Claims, 4 Drawing Sheets

U.S. PATENT DOCUMENTS 2,786,656 3/1957 Corneil .
2,974,880 3/1961 Stewart et al. ..... 239/570
3,187,748 6/1965 Mitchell et al. .
3,319,894 5/1967 Coodrider ..... 239/333 X
3,330,277 7/1967 Gabriels .
3,396,874 8/1968 Malone .
3,421,662 1/1969 Hanson .
3,471,065 10/1969 Malone .
3,575,322 4/1971 Jordon .
3,605,738 9/1971 Ciranna .
3,628,875 12/1971 Wild .
3,790,034 2/1974 Horvath .
3,797,748 3/1974 Nozawa et al. .
3,831,861 8/1974 Hanson, Jr. .
3,838,686 10/1974 Szekely .
3,878,973 4/1975 Riccio .
3,921,857 11/1975 Riccio .
3,921,861 11/1975 Kondo .
3,923,202 12/1975 Riccio .
3,933,279 1/1975 Maier .
4,007,855 2/1977 Hierath et al. .
4,017,007 4/1977 Riccio .
4,147,476 4/1979 Warren .
4,167,941 9/1979 Capra et al. .
4,183,449 1/1980 Blake .
4,260,082 4/1981 Rooney et al. .
4,271,875 6/1981 Meshberg .
4,294,410 10/1981 Gueret ..... 239/590.5 X
4,345,718 8/1982 Horvath .
4,414,972 11/1983 Young et al. .
4,441,634 4/1984 Meshberg .
4,506,497 3/1985 Feuerlohn .
4,534,345 8/1985 Wetterlin .
4,648,393 3/1987 Landis et al. .
4,667,668 5/1987 Wetterlin .
4,693,675 9/1987 Venus, Jr. .
4,694,977 9/1987 Graf et al. .
4,810,659 3/1989 Higo et al. .
4,819,834 4/1989 Thiel .
4,860,738 8/1989 Hegemann et al. .
4,867,347 9/1989 Wass et al. .
4,875,605 10/1989 Weston .
4,892,232 1/1990 Martin .
4,896,832 1/1990 Howlett .
5,056,511 10/1991 Ronge .
5,088,649 2/1992 Hanson et al. .
5,110,048 5/1992 Waldrum ..... 239/171
5,115,981 5/1992 Callahan et al. .

NOZZLE ASSEMBLY FOR PREVENTING BACK-FLOW

This invention relates to a valve, notably to a non-return valve which can also act as a filter for use in devices for forming sprays of droplets.

BACKGROUND TO THE INVENTION

Many forms of device have been proposed for dispensing fluids, for example medicaments, as sprays of fine droplets or aerosols. In some forms of device, it has been proposed that the aqueous solution of the medicament or other active ingredient be discharged through a fine orifice nozzle to form the spray using mechanical pressurizing means, for example using a compressed spring to drive a piston in a cylinder containing the fluid; in others, a pressurized gas is used as the propellant. For convenience the term pressurizing means will be used herein to denote all means by which the pressure required to dispense the fluid is generated and includes mechanical and pressurized gas operated means.

Where very small nozzle apertures, for example those having a diameter of 10 micrometers or less, are used to form fine droplets sizes, it is important to ensure that such small orifice apertures do not become blocked. It has therefore been proposed to provide a filter in the fluid discharge line upstream of the nozzle aperture. Small dimension filters are available, and these typically comprise a mesh or gauze which has a mesh aperture size as low as 3 micrometers or less. However, such filters are flimsy and therefore require some support means to prevent rupturing under the large pressures generated by the pressurizing means. Furthermore, such filters and their support means are additional and often expensive components.

There is, therefore, a continuing requirement for an effective and reliable filter capable of filtering fluid stream down to a very small particle sizes. In spray generating devices, there is usually also a requirement for a non-return valve positioned between the pressurizing means and the atomizing nozzle orifice so as to reduce the risk of residual fluid in the nozzle assembly draining back into the pressurization chamber and contaminating fluid held in a reservoir in the device.

We have devised a form of nozzle assembly incorporating a non-return valve assembly which provides a simple and effective means for reducing the risk of drain back of fluid from the nozzle assembly and may also be used to provide the functions of a filter and/or a filter gauze support in the nozzle assembly.

SUMMARY OF THE INVENTION

Accordingly, from one aspect, the present invention provides a nozzle assembly comprising a conduit in fluid flow communication with a nozzle aperture through which fluid is adapted to be discharged as a spray of droplets, characterised in that the effective minimum cross-sectional area of the conduit transverse to the line of flow of fluid at that point is selected so that flow of fluid through said conduit is restricted by the minimum effective cross-sectional area whereby back-flow of fluid from said nozzle aperture through said conduit at an ambient pressure differential and at an operational pressure differential is substantially prevented.

The invention also provides a spray generating device incorporating a nozzle assembly of the invention.

The term effective is used herein with respect to the cross-sectional area of the conduit to denote that cross-section of the conduit which is not occupied by an infill or other member, and through which fluid may flow. Thus, the conduit may be a fine bore tube, in which case the effective cross-sectional area is the cross-section of the fine bore. However, the conduit may also be in the form of a wide bore chamber into which is fitted a solid or hollow plug which reduces the free cross-sectional area of the chamber through which fluid can flow.

For convenience, the term upstream will be used herein to denote the direction opposed to a flow of fluid from the conduit to the nozzle aperture; the term discharge flow to denote a flow of fluid from the conduit to the nozzle aperture; and the term back flow to denote a flow of fluid from the nozzle aperture back to the conduit.

The clearance or passageway(s) within or between components of the nozzle assembly forming the conduit through which the flow of fluid is restricted acts to minimize the back flow of fluid in the nozzle assemblies of the invention during the rest state of a spray generating device incorporating the nozzle assembly or when suction is applied to the nozzle assembly as the pump or other means for discharging the spray is re-cocked after use. During the rest state there will usually be no pressure differential across the nozzle assembly and it will be the surface tension effects at the nozzle aperture and the flow resistance caused by the walls of the passageway(s) which restrict back flow of fluid. However, when a pump or other discharge means is being re-cocked, some suction may be applied to the nozzle assembly, typically to give an operational pressure differential of about 0.2 to 0.5 bar across the nozzle assembly, although it is possible that a pressure differential across the nozzle assembly of up to 1 bar could be drawn during the suction stroke of the pump. The nozzle assemblies of the invention should therefore be dimensioned so that the surface tension and other flow restrictive effects prevent flow through the nozzle assembly when a minimum pressure differential of about 0.2 bar, preferably 1 bar, is applied across the assembly. In order to provide a measure of safety, for example if the spray generating device is dropped or otherwise subjected to sudden forces, it will usually be preferred that a pressure differential of up to 3 bar causes no significant flow of fluid through the nozzle assembly of the invention in the event that the device is dropped. The term ambient pressure differential is therefore used herein to denote the pressure differential across the nozzle assembly, ie. between the exterior of the nozzle aperture and the upstream inlet to the conduit, when the nozzle assembly or the spray generating device incorporating it is in its rest condition. Operational pressure differential is used herein to denote the pressure differential across the nozzle assembly when the device is being re-cocked in preparation for a subsequent discharge stroke of the spray generating device of which the nozzle assembly forms part.

Although the ambient and operational pressure differentials are not sufficient to cause back flow of fluid through the nozzle assembly, when the spray generating device is operated, the fluid is pressurized, often to up to 500 bars, to discharge the fluid as a spray of fine droplets from the nozzle aperture. The high pressure differential across the nozzle assembly overcomes the surface tension and other flow restriction effects of the nozzle assembly and forces the fluid through the nozzle assembly. Typically, significant flow of fluid through the nozzle assembly to form a spray occurs in excess of about 50 bars pressure differential across the nozzle assembly of the invention, although a slow flow of fluid may occur at pressure differentials below this, for example at above 10 to 25 bars.

The conduit(s) serving to restrict the back flow of fluid can be provided by one or more fine bore tubes or conduits in the housing. Such fine bores can be formed as bores leading radially from an annular feed gallery to the axial bore to the nozzle orifice 14 or can be axial bores within the housing, for example formed by laser drilling the bores in a plastic or similar nozzle block and securing a nozzle plate having the appropriate radial connecting grooves or bores to connect the fine bores to the nozzle aperture to the end face of the nozzle block. Alternatively, the flow restriction can be provided by constricting a wider bore tube feeding fluid to the nozzle aperture.

However, it is preferred to form the conduit as a comparatively wide bore chamber and to achieve the restriction of the back flow by locating an infill member within the chamber. The infill member can be a flat plate with holes therethrough of the desired aperture size and shape, or a ceramic or other fritted or bonded material with a suitable foraminous or porous structure so that the infill member occupies the full width of the chamber and the fluid flows through the pores or apertures in the infill member. However, it is preferred that the infill member be a solid or hollow plug which does not extend fully to the side or end walls of the chamber so that the clearance gap between the infill member and the side and/or end walls of the chamber form the required restricted flow passageways. These passageway(s) can be radial, as when the infill member does not extend fully to the end of the chamber, and/or can be axial as when the clearance is between the side walls of the infill member and the chamber. However, it is within the scope of the present invention for the infill member to carry one or more circumferential ribs or the like and for the clearance fit to be between the radially outward extremities of these and the opposing wall of the chamber to provide the flow restriction(s) or vice versa where the chamber wall carries the circumferential ribs. Similarly the clearance between the transverse end wall of the chamber and the end face of the infill member can be provided by the axially extreme faces of one or more annular ridges carried by the chamber wall or the infill member. For convenience, the invention will be described hereinafter in terms of opposing walls of the chamber and infill member which do not carry such ribs. Preferably, the passageway(s) are axial and for convenience the invention will be described hereinafter in terms of an annular axial passageway formed by the clearance gap between the side walls of the chamber and the infill member. It will be appreciated that the passageway(s) can also be provided by axial grooves in the surface of the infill member. It is also preferred that the infill member be provided with one or more radial ducts, for example grooves or ribs, which allow fluid to flow across the end faces of the infill member to the annular passageway.

In a particularly preferred form of the nozzle assembly of the invention, the conduit is provided as a blind ended axial chamber having the nozzle aperture located at or adjacent the blind end of the chamber, preferably in the transverse end wall of the chamber; and the infill member is substantially congruent with the internal transverse end wall and/or the axial side walls of at least the blind end of the chamber and is a clearance fit therein to form the passageway(s) between the opposed walls of the chamber and the infill member.

It is particularly preferred that the chamber be cylindrical and that the infill member be a corresponding cylinder to form an annular passageway between the internal radial wall of the chamber and the external radial wall of the infill member, although other cross-sectional shapes, for example triangular or hexagonal, may be used if desired. For convenience, the invention will be described hereinafter in terms of a generally cylindrical housing having a circular cross-section chamber formed within it.

The optimum radial and axial dimensions for the flow restricting passageway(s) can readily be determined for any given case by simple calculations from the rheological properties of the fluid and by simple trial and error tests. Preferably, the minimum cross-sectional dimension of the passageway(s) in the nozzle assembly, for example the clearance between the relevant walls of the infill member and the chamber, is less than the maximum dimension, for example the diameter, of the nozzle aperture, whereby the passageway(s) serves both as a flow restrictor to reduce back flow of the fluid and as a filter for the fluid flowing through the nozzle assembly. Typically, the passageway(s) will have a flow-transverse dimension of from 1 to 50 micrometers, notably less than about 20 micrometers, for example from 2 to 10 micrometers. The required dimensions between the infill member and the walls of the chamber within which it is located can be achieved by making the infill member a tight clearance fit within the chamber so that the roughness of the opposed surfaces provides the necessary clearance fit.

We believe that flow restriction valves incorporating the chamber and infill member concept described above are novel. The invention therefore also provides a device for controlling the flow of a fluid, which device comprises:

a. a housing member having an internal chamber through which fluid is adapted to flow; and
b. a static infill member located within the chamber and forming a passageway for the flow of fluid between the internal wall of the chamber and the external wall of the infill member, which passageway is dimensioned so as to restrict the back flow of fluid therethrough at an ambient pressure differential and at an operational pressure differential.

Preferably, the nozzle aperture is formed as an integral part of the housing member within which the chamber and conduit are formed, for example as an axial bore or conduit fed from the chamber within the housing body. The nozzle aperture can take a number of forms, but is preferably an aperture in a jewel or metal nozzle orifice member, for example the transverse end wall of the chamber, through which the fluid is fed under pressure from the chamber. Preferably, the nozzle orifice has an aperture diameter of less than 10 micrometers, for example from 2 to 6 micrometers. If desired, the nozzle orifice can be non-circular or the nozzle assembly can incorporate a swirl chamber and/or other means for enhancing the production of fine droplets, for example droplets with a mass median diameter of less than 10 micrometers. Such other means can be, for example, an impingement ball, plate, blade or other static or vibrating surface. Where a non-circular aperture is employed, it is preferred that the ratio of the maximum radial dimension of the aperture to its minimum radial dimension be at least 2:1, eg. from 3:1 to 10:1, and that any angles in the lip of the aperture be sharp.

As indicated above, the nozzle assembly of the invention may act to separate solid particles from the fluid passing through it where the passageway(s) in the assembly are smaller than the maximum nozzle aperture dimensions. However, it may be preferred to incorporate one or more separation means, for example a conventional fine aperture metal gauze filter mesh, notably one having a mesh aperture size in the range 1 to 10 micrometers, to separate solid particles from the fluid upstream of the passageway(s) in the nozzle assembly. Conveniently, such separation means are provided by a disc of suitable filter mesh which is located within the chamber of the nozzle assembly immediately upstream of the infill member and is supported by the upstream end face of the infill member.

Thus, in a particularly preferred form of the nozzle assembly of the invention, the assembly is formed from generally cylindrical housing having a blind ended cylindrical axial chamber substantially co-axially therein so that the nozzle assembly has radial symmetry; and the axial configuration is that the nozzle aperture is formed in the transverse end wall of the chamber, the infill member is located within the chamber and immediately adjacent the transverse end wall of the chamber, the separation means is located transversely and adjacent the upstream face of the infill member and the open end of the housing is crimped over or provided with other means whereby the assembly is retained as a unitary construction.

As indicated above, the nozzle assembly of the invention finds especial use with spray generating devices. The exact nature, form of construction and method of operation of the spray generating device can be of any suitable type, for example a pressurized or liquefied gas propellant aerosol can type device. However, the invention is of especial use with mechanically actuated devices in which a measured dose of fluid is subjected to an increase in pressure to expel the fluid through the nozzle assembly of the invention.

The MDI (metered dose inhaler) shown in FIG. 6 comprises a body in which there is defined a cylinder 2 of circular cross-section, in which a piston 3 is mounted for reciprocating movement. The cylinder 2 communicates with a pressure chamber 4 of reduced cross-section. The piston 3 has a reduced diameter portion 5 which sealingly engages within the pressure chamber 4, by means of a plastic (e.g., PTFE or Nylon) sealing cap or ring provided on the piston portion 5. The seal may be formed integrally with the reduced diameter portion 5 of the piston—for example, as a cap, rib or bead.

A pre-loaded compression spring 6 is located in the cylinder 2, between the enlarged head of the piston 3 and an opposite end wall of the cylinder 2. An operating rod 631 is connected to the piston 3, and passes through the spring 6 and through a passageway 34 in the body 1, to protrude from the body 1. At or adjacent an end of the rod 631 there is provided a handle means 32 for moving the rod 631 and the piston 3. If desired, the end of rod 631 can be connected to a trigger mechanism or lever mechanism incorporating a mechanical advantage so that the user can readily operate the device against the compressive force of spring 6. A latching means 33 provided on the body 1 engages with the rod 631, to latch the rod 631 in a loaded position, as illustrated in FIG. 6. An actuating button 35 is provided, for releasing the latching means 33.

Also defined within the body 1 is a cavity 65 in which there is located a collapsible bag 60 containing the product to be dispensed (e.g., a liquid drug). A door 66 on the side of the body 1 may be opened, in order to exchange the collapsible bag 60. By means of a connector 62, the interior of the bag 60 communicates with an inlet passage 61 which, in turn, communicates with the pressure chamber 4 via a non-return valve 63.

Also connected to the pressure chamber 4 is an outlet passage 621 which extends from the pressure chamber 4 to an atomizing head 22, via a non-return valve 23 and a pressure release valve 25.

Optionally, the body 1 is provided with a mouthpiece 40, which affords an atomization chamber around the atomizing head 22.

In use of the MDI of FIG. 6, when the piston 3 is in the loaded position as illustrated in FIG. 6, the pressure chamber 4 is full of liquid which has been supplied from the bag 60, via the passage 61 and non-return valve 63. The compression spring 6, as mentioned above, is already pre-loaded when fitted in the cylinder 2. The loading of the spring is increased further by withdrawing the rod 631 and thereby the piston 3 to the loaded position that is illustrated in FIG. 6.

The rod 631 is latched in its loaded position as illustrated in FIG. 6, by the latching means 33. Upon depressing the actuating button 35, the latching means 33 is released, thereby allowing the piston 3 to move suddenly forward under the force of the compression spring 6, to impart a sudden pressure pulse to the liquid in the pressure chamber 4.

The pressure in the liquid in the pressure chamber 4 therefore quickly builds up to exceed the limit value of the pressure release valve 25, and the liquid is then ejected under high pressure through the outlet passage 621 to the atomizing head 22, via the one-way valve 23. During the forward travel of the piston 3, the non-return valve 63 prevents liquid from being returned to the bag 60, via the inlet passage 61. As the liquid is ejected through the atomizing head 22, it is atomized into a fine spray, which can then be inhaled. The optional mouthpiece 40 provides an atomization chamber within which the fine spray is enclosed, and facilitates the inhalation of the spray.

To reload the MDI, the rod 631 is pulled back by means of the handle 32 against the resilient bias of the spring 6 and, at the end of its travel, the latching means 33 automatically latches the rod 631 into a latched end position. During this travel of the piston 3, liquid is sucked out of the collapsible bag 60 into the pressure chamber 4, via the inlet passage 61 and one-way valve 63. At this time, the one-way valve 23 prevents air being sucked into the pressure chamber 4 via the outlet passage 621. Due to the latching of rod 631, the fluid in pressure chamber 4 is held at ambient pressure and there is little or no risk of loss of fluid from the chamber. The operation of latching means 33 provides the user with a clear indication when piston 3 has completed the desired travel within cylinder 2 and that the required dose of fluid has been taken up. If the user fails to withdraw rod 631 to a sufficient extent, the latching means 33 will not engage and the user will detect the spring bias from spring 6 and will know to withdraw rod 631 further. The latching means 33 thus provides both the means for holding fluid in chamber 4 under ambient pressure and a means for alerting the user to incomplete operation of the device, hence reducing the risk of variable operation of the device.

Thus, the MDI is again in a loaded position, as illustrated in FIG. 6, ready for firing.

DESCRIPTION OF THE DRAWINGS

To aid understanding thereof, the invention will now be described with respect to a preferred form thereof as shown in the accompanying drawings, in which.

DESCRIPTION OF THE PREFERRED EMBODIMENTS

Figure 1:
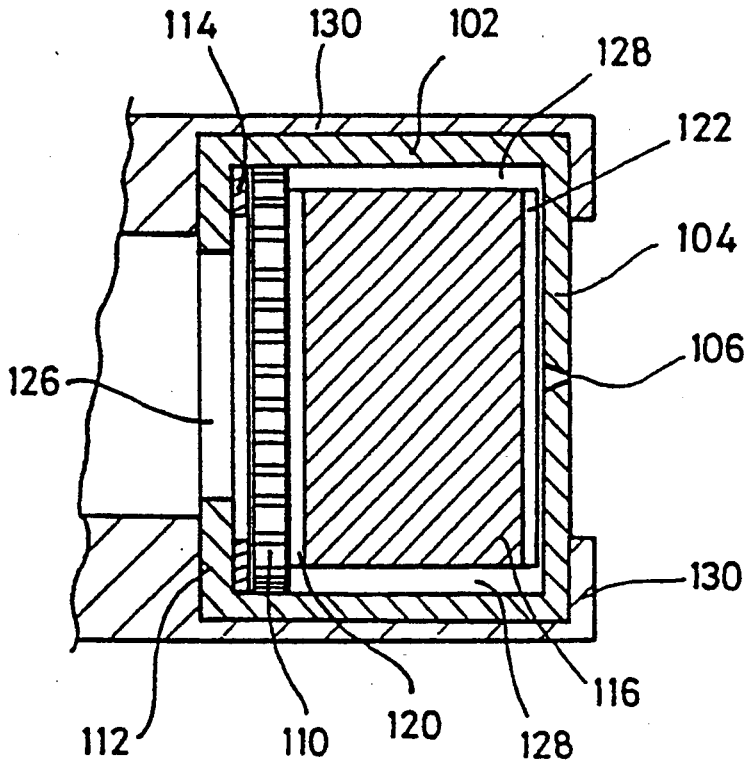
FIG. 1 is a diagrammatic axial cross-section through one form of the nozzle assembly of the invention.

The device of the invention, notably that shown in FIG. 1, is of particular use in the atomization of aqueous solutions of medicaments, notably in measured dose inhalation devices (MDI's). For convenience the invention will be described in respect of a device for such use.

The device comprises a main hollow generally cylindrical housing body 102 having one end closed by a transverse end wall 104 to define a blind ended chamber located substantially co-axially within it. The closed end wall 104 is provided with a fine bore nozzle aperture 106 directed generally axially and located with its axis substantially co-incident with the longitudinal axis of the body 102. A transverse filter mesh 110 is located within the open end of body 102 and is held within the body by folding over the exposed lip of the body 102 to form an annular retaining flange 112 as shown. This also forms the axial entry port 126 to the chamber within body 102. A plastic sealing ring or gasket 114 or the like is located between said flange 112 and the filter 110.

A cylindrical infill member 116 is located substantially co-axially within the chamber within the body between the filter 110 and the end wall 104. This cylinder is formed with its radially outward face substantially congruent to the interior wall of the chamber. The upstream end face of the cylinder 116 acts to support the filter 110. One or more radial grooves or ribs 120 and 122 are formed in both end faces of the cylinder 116 to allow the passage of fluid from the entry port 126 to the nozzle aperture 106. An annular passageway is formed between the radially outward wall of cylinder 116 and interior wall of the chamber in body 102 to allow fluid to flow past the cylinder 116. The flange 112 is folded into place after assembly of the cylinder 116, filter 110 and gasket 114, to retain the nozzle assembly as a unitary whole in which the cylinder 116 is retained against axial movement within the chamber of body 102.

The body 102 is securely held in position on the MDI or other spray generating device by any suitable means, for example by means of a crimped over sleeve extension 130 to the body of the spray generating device. Alternatively, the body 102 can be screw threaded, bayonet fitted, welded or otherwise secured to the body of the spray generating device, for example to the valve outlet stem of a pressurized container.

The clearances between the end faces of the cylinder and the filter 110 and the transverse end wall 104 and/or the clearance between the radially outward wall of the cylinder and the inner wall of the chamber are selected so that the ambient and operational pressure differential experienced between nozzle aperture and the inlet 126 will not be sufficient to cause a back flow of fluid from the nozzle aperture to the inlet 126. Typically, the clearance is also selected so that it will act to filter out particles which pass through filter mesh 110 so that the nozzle aperture 106 is not blocked by them. Thus, for a 5 micrometer nozzle aperture, it will usually be preferred that the radial passageways 120 and 122 have an axial dimension of from 1 to 4 micrometers, notably about 2.5 micrometers. Such dimensions for the radial passages also provide an adequate restriction on back flow under most conditions. Where the annular passageway 128 is to provide the back flow restriction, similar radial dimensions for the annular clearance have been found to give satisfactory results both as a filter and to restrict back flow. Such clearances can conveniently be achieved by a rough finish to the interior walls of the chamber within the body 102 and/or to the exterior of cylinder 116. Thus, if the cylinder is a push fit within the housing and can just be rotated manually therein, the clearance is typically as required by the present invention.

In operation of the spray generating device, a metered dose of the medicament or other fluid is applied under pressure to inlet 126, typically at from 100 to 400 bars. This overcomes the surface tension and drag effects in the nozzle assembly and forces fluid to flow via the radial grooves 120 into the annular axial passageway 128 and then via radial grooves 122 to the nozzle aperture 106. When the spray has been discharged, there is no significant pressure differential between the chamber within the assembly and the ambient environment downstream of the nozzle aperture. If anything, there is a slight positive pressure within the chamber due to the restriction to free flow achieved by the nozzle assembly. Back flow of fluid to inlet 126 from the nozzle aperture 106 is substantially prevented due to the small dimensions of the grooves 120, 122 and the annular passageway 128.

When the spray generating device is re-loaded for a subsequent operation, a negative pressure of no more than approximately 1 bar max vacuum is generated at the entry 126 as the measured dose of fluid is drawn into the measuring chamber (not shown) by retraction of a piston in a cylinder or other means. However, the flow restriction imposed by the combined passageway formed by the grooves 120 and 122 and the annular passageway 128 prevents the pressure differential between the nozzle aperture and the inlet 126 from moving any fluid in said passageway remaining from the previous discharge operation of the spray generating device. However, the large positive pressure generated when dispensing the fluid is sufficient to overcome the surface tension forces and other flow restrictions to ensure that the fluid is dispensed as a spray from the nozzle aperture.

Figure 2:
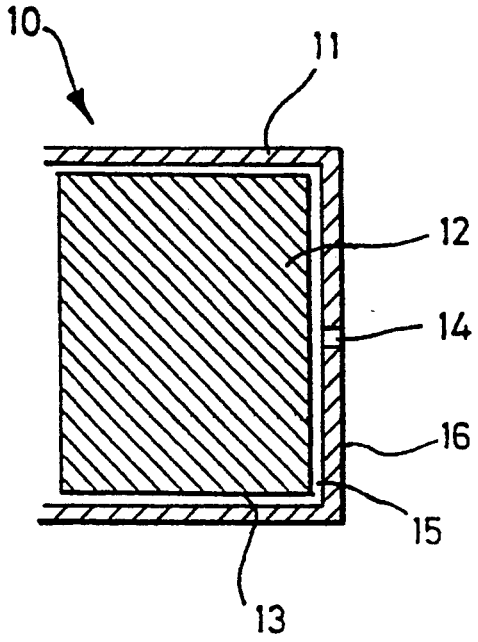
FIGS. 2, 3 and 4 are axial cross-sections through alternative forms of the nozzle assembly.

In the variation of the nozzle assembly 10, shown in FIG. 2, the filter mesh is omitted and the annular passageway 13 between the cylinder 12 and the chamber wall 11 provides an effective filter for solid particles where the radial dimension of the passageway 13 is about half the diameter of the nozzle aperture 14 formed in the end face 16. Again the radial passage(s) 15 between the end wall 16 and the end face of the cylinder 12 may be fine to assist the operation of the annular passageway or may be large enough to have little or no back flow restriction effect. The clearance between the cylinder 12 and the wall 11 works both as a filter and as a non-return valve.

Figure 3:
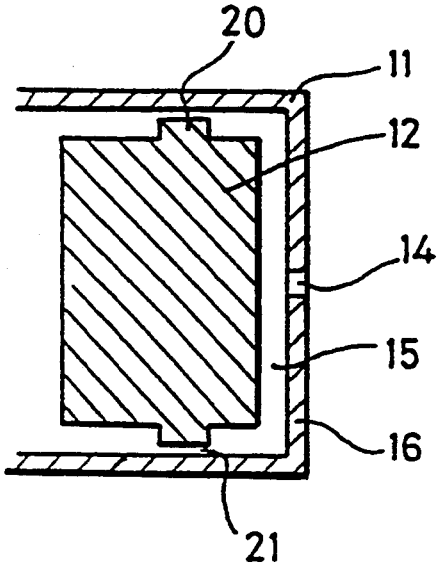
Figure 4:
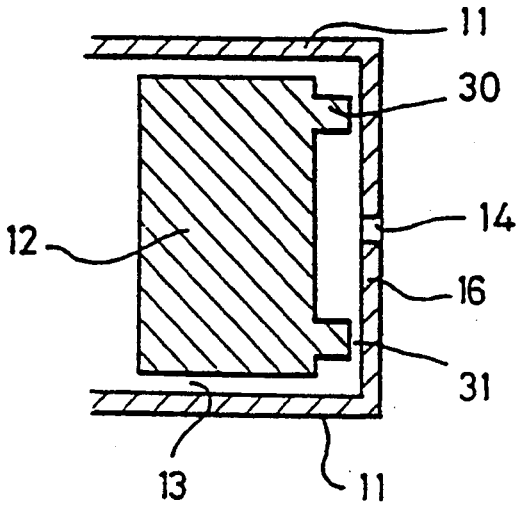

In the variations shown in FIGS. 3 and 4, the clearance is provided between as the radial clearance 21 between a radial projection, for example a circumferential rib 20, on the cylinder 12 and the axial wall 11 of the chamber (in FIG. 3); or as the axial clearance 31 between an annular axially extending rib 30 carried by the end face of the cylinder 12 (in FIG. 4). The ribs shown in FIGS. 3 and 4 could be carried by the chamber walls 11 and/or 16 and not upon the cylinder 12 as shown.

Figure 5:
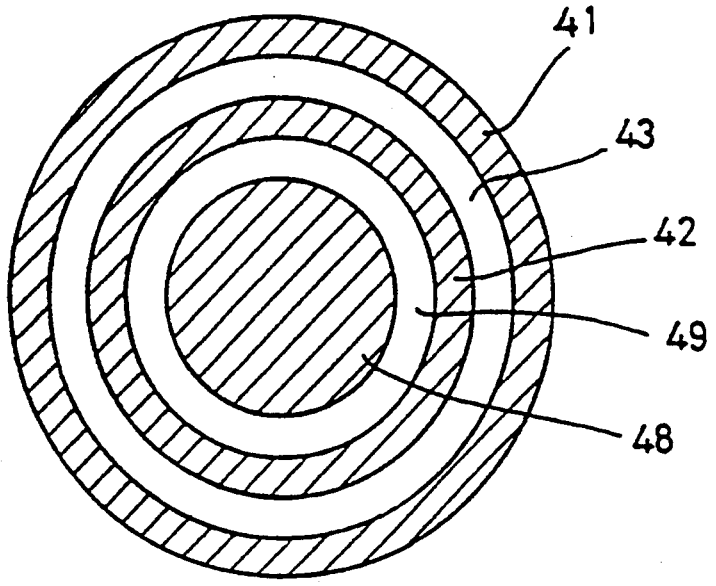
FIG. 5 is an axial plan view of an alternative form of the infill device for use in the assembly of FIG. 1.
Figure 6:
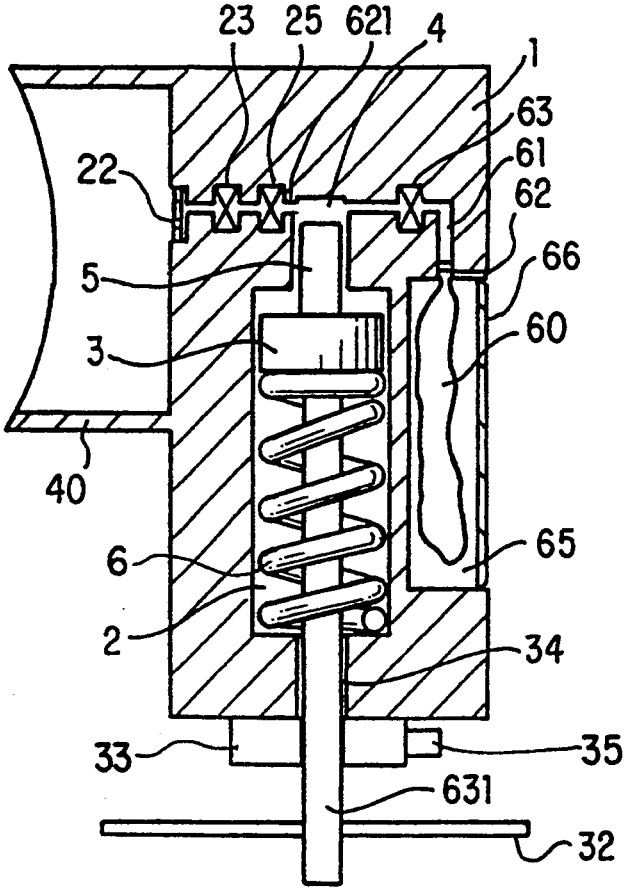
FIG. 6 shows a spray generating device configured with the nozzle assembly of the present invention.

In the form of nozzle assembly as shown in FIG. 5, the cylinder 12 is formed as a composite structure from a series of annular sleeves 41, 42 mounted co-axially upon one another with the inner sleeve mounted upon a solid cylinder 48. Annular clearances 43 and 49 between each sleeve and the next provide a number of axial passageways in the overall cylinder construction which act in the same way as the annular passageways 13 or 21 in FIGS. 3 and 4.

With water based solutions, the fluid is applied to the inlet 126 of the nozzle assembly of FIG. 1 at a pressure of between 100 and 400 bars. For a nozzle aperture of mean diameter of 5 micrometers, the nozzle assembly will filter out particles above about 2.5 micrometers size with an annular gap 128 of about 2.5 micrometers. Where the annular gap 128 in the nozzle assembly is not to act as a filter, but the nozzle assembly relies upon the filter 110 to remove solid particles, the annular gap 128 can be larger, for example as much as 50 micrometers. With these pressures and dimensions, we have found it sufficient to use rough surfaces at the faces of the cylinder to act as the fluid grooves 120 and 122. Likewise the annular passageway 128 can be formed by the roughness of the surface finish of the body 102 and cylinder 116.

We claim:

1. A spray generating device, comprising:

pressurizing means for applying a predetermined amount of energy to a metered quantity of fluid in order to subject the fluid to a predetermined increase in pressure by transitioning from a loaded configuration to a rest configuration;

retaining means for retaining said pressurizing means in said loaded configuration;

releasing means for releasing said retaining means so that said pressurizing means transitions from said loaded configuration to said rest configuration to thereby subject the fluid to said predetermined increase in pressure; and a nozzle assembly which comprises a nozzle aperture for discharge of the fluid as a spray of droplets, and a conduit in fluid flow communication with said nozzle aperture, wherein the flow of fluid through said conduit is restricted by the minimum effective cross-sectional area of said conduit transverse to the line of flow of fluid through said conduit, wherein transitioning said pressurizing means from said rest configuration to said loaded configuration creates suction, said suction being insufficient to cause back-flow of fluid from said nozzle aperture into said conduit.

2. A spray generating device as claimed in claim 1, wherein said conduit comprises a fine bore tube and said effective cross-sectional area is the transverse cross-section of said fine bore tube.

3. A spray generating device as claimed in claim 2, further comprising: a filter element.

4. A spray generating device as claimed in claim 1, wherein said conduit comprises a chamber of greater cross-sectional area than said nozzle aperture, and further comprising a static infill member located within said conduit so as to occupy at least part of the cross-section of said chamber.

5. A spray generating device as claimed in claim 4, wherein a first passageway is formed between an end wall of said conduit and an end wall of said infill member.

6. A spray generating device as claimed in claim 5, wherein said chamber comprises an axial chamber having a blind end, said nozzle aperture located adjacent said blind end of said axial chamber, and said infill member is substantially congruent with an internal transverse end wall of said blind end of said axial chamber and is a clearance fit therein to form said first passageway.

7. A spray generating device as claimed in claim 5, wherein a second passageway is formed between a side wall of said conduit and a side wall of said infill member.

8. A spray generating device as claimed in claim 7, wherein said chamber comprises an axial chamber having a blind end, said nozzle aperture located adjacent said blind end of said axial chamber, and said infill member is substantially congruent with an internal side wall of said blind end of said axial chamber and is a clearance fit therein to form said second passageway.

9. A spray generating device as claimed in claim 7, wherein flow of fluid through said nozzle assembly is substantially prevented when a pressure differential substantially equal to 0.2 bar is applied across said nozzle assembly.

10. A spray generating device as claimed in claim 7, wherein the minimum cross-sectional dimension of said second passageway is less than the maximum dimension of said nozzle aperture, wherein said second passageway serves both as a flow restrictor to reduce back flow of fluid and as a filter for said fluid flowing through said nozzle assembly.

11. A spray generating device as claimed in claim 5, wherein the minimum cross-sectional dimension of said first passageway is less than the maximum dimension of said nozzle aperture, wherein said first passageway serves both as a flow restrictor to reduce back flow of fluid and as a filter for fluid flowing through said nozzle assembly.

12. A spray generating device as claimed in claim 1, wherein flow of fluid through said nozzle assembly is substantially prevented when a pressure differential substantially equal to 0.2 bar is applied across said nozzle assembly.

13. A spray generating device as claimed in claim 1, further comprising: a filter element.

14. A method of discharging a fluid as a spray of droplets, comprising the steps of:

loading a pressurizing means by transitioning said pressurizing means from a rest configuration to a loaded configuration;

retaining said pressurizing means in said loaded configuration;

transitioning said pressurizing means from said loaded configuration to said rest configuration to thereby subject a metered quantity of fluid to a predetermined increase in pressure; and flowing the fluid through a nozzle assembly which comprises a nozzle aperture for discharge of the fluid as a spray of droplets, and a conduit in fluid flow communication with said nozzle aperture, wherein the flow of fluid through said conduit is restricted by the minimum effective cross-sectional area of said conduit transverse to the line of flow of fluid through said conduit, wherein said loading step creates suction, said suction being insufficient to cause back-flow of fluid from said nozzle aperture into said conduit.

15. A method as claimed in claim 14, wherein said flowing step is performed so that the flow of fluid through said nozzle assembly is substantially prevented when a pressure differential substantially equal to 0.2 bar is applied across said nozzle assembly.

16. A spray generating device, comprising:

a spring-loaded pump mechanism, wherein transitioning said pump mechanism from a loaded configuration to a rest configuration applies a predetermined amount of energy to a metered quantity of fluid in order to subject the fluid to a predetermined increase in pressure and transitioning said pump mechanism from said rest configuration to said loaded configuration creates suction;

retaining means for retaining said pump mechanism in said loaded configuration;

releasing means for releasing said retaining means so that said pump mechanism transitions from said loaded configuration to said rest configuration to thereby subject the fluid to said predetermined increase in pressure; and a nozzle assembly which comprises a nozzle aperture for discharge of the fluid as a spray of droplets, and a conduit in fluid flow communication with said nozzle aperture, wherein the flow of fluid through said conduit is restricted by the minimum effective cross-sectional area of said conduit transverse to the line of flow of fluid through said conduit, wherein the suction created by transitioning said pump mechanism from said rest configuration to said loaded configuration is insufficient to cause back-flow of fluid from said nozzle aperture into said conduit.

* * * * *